United States Patent [19]

Marvin

[11] 4,359,946

[45] Nov. 23, 1982

[54] ELEVATED DOWNHILL TRANSPORT SYSTEM

[76] Inventor: Mark C. Marvin, 25 Floral Rd., Peekskill, N.Y. 10566

[21] Appl. No.: 868,400

[22] Filed: Jan. 10, 1978

[51] Int. Cl.[3] ..... E01B 25/18

[52] U.S. Cl. ..... 104/93; 104/113; 105/151; 182/10

[58] Field of Search ..... 104/173 R, 112, 113, 104/115, 116, 93; 105/150, 151; 182/10, 191

[56] References Cited

U.S. PATENT DOCUMENTS 674,870 5/1901 Mitchel ..... 105/151

1,685,720 9/1928 Nelson ..... 104/116

FOREIGN PATENT DOCUMENTS 1447028 8/1976 United Kingdom ..... 104/113

*Primary Examiner*—David M. Mitchell

*Assistant Examiner*—Ross Weaver

[57] ABSTRACT

An elevated downhill transport system is provided with a cable system and appropriate towers to support the cable along a variable downhill course. A single cable only, being necessary, a cable trolley is also provided that prevents the carriage from accidently leaving the cable during any part of the descent. The system relies on no outside power except gravity for the descent. Ascent can be provided for by pre-existing ski lift equipment. The entire system is simple, inexpensive and transportable, lending itself to portable operation.

1 Claim, 3 Drawing Figures

ELEVATED DOWNHILL TRANSPORT SYSTEM

This invention relates to amusement type devices that are found in amusement parks but which are applicable to use in vacant summer time ski resorts. Presently, ski areas are vacant or used only as sightseeing cable car rides. The thrills of a swift downhill ride need not be restricted to snowy weather, nor to a circular ride as found in a park.

Luck and Thorpe (1975) patented a downhill recreational facility consisting of slide segments. Such a system, because of its either lack of transportability, or lack of durability is not suitable for use on summer ski slopes. Also high speeds cannot readily be achieved without the danger of leaving the slide.

Miklosy's (1976) personalized rapid transport system is not designed for gravity power and is similar in principal, but not of similar purpose and doesn't adapt as a downhill recreation system.

Maier, et. al. (1976) patented a creeling apparatus consisting of an overhead rail system and trolleys, but is claimed for creeling bobbins even though very similar to this application's downhill system.

No non-snow downhill recreation rides are presently in use on ski areas.

The principal object of this invention is to provide a downhill recreation system for use on ski slopes during periods when no snow is present, and to provide an amusement ride capable of reaching high speeds safely, using the power of gravity.

A further object of the invention is to provide an elevated cable system with appropriate supporting structures for use as a downhill transport system so that the supporting structures are easy to assemble and disassemble, and are light, flexible, strong, and in no way interfere with the downhill ride of the carriages.

Another object of the invention is to provide a trolley system that contacts the cable and rides upon it, and is quickly removable when necessary, but will not under any circumstances leave the cable during the descent.

Other objects and advantages of the invention will become better understood hereinafter from a consideration of the specification with reference to the accompanying drawings forming part thereof, and in which like numerals correspond to like parts throughout the several views of the invention, and wherein.

Figure 1:
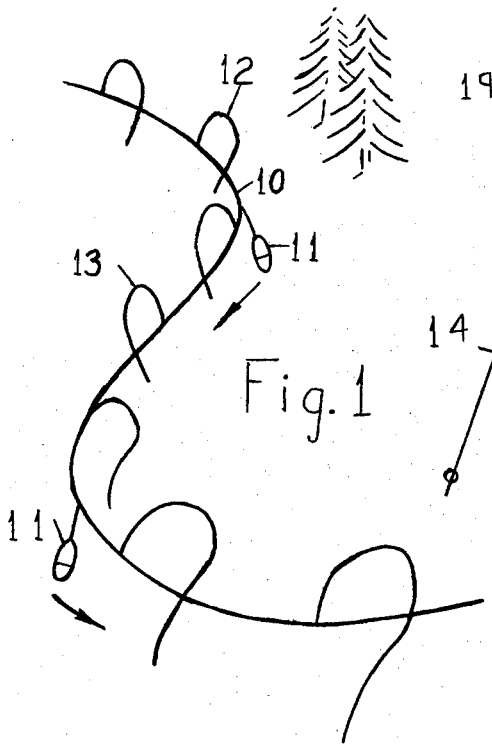
FIG. 1 is a total overview of the invention in operation
Figure 2:
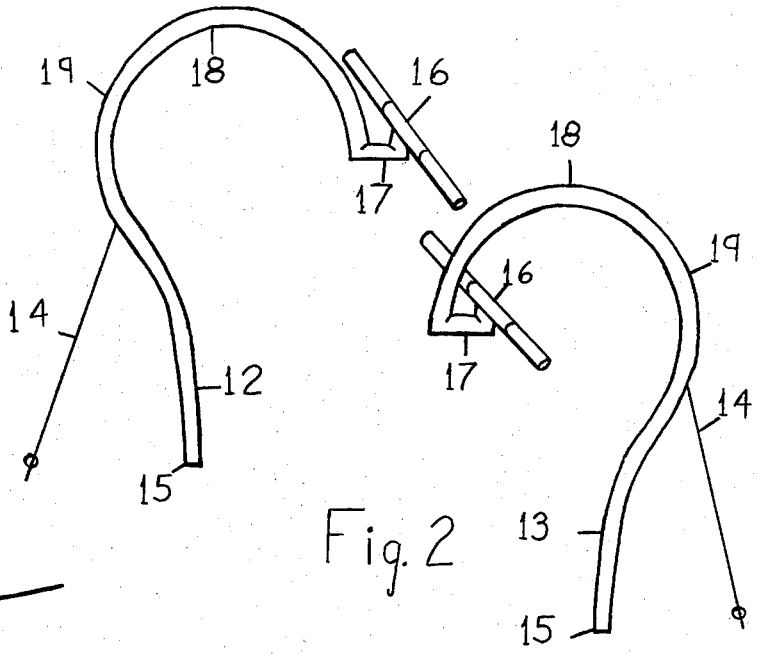
FIG. 2 is a detail view of the front of two of the supporting structures.

Referring to the drawing, the elevated downhill transport system is comprised of the cable 10, and the carriage 11 supported by and suspended between the supporting towers 12 and 13. In FIG. 2, the right side (open) of tower 12 and the left side (open) of tower 13, are used as necessary, the open side facing the direction that the carriage 11 pulls, due to centrifugal force, on its downhill course. Each tower is strengthened by the support wire 14 to prevent extreme bending while in operation, and is anchored in the ground at its base 15. The cable 10 is connected to the tower and is contained within the cable clamp 16 at each respective tower. The horizontal support arm 17 is rigid, but the superior curve 18 of the tower and the far curve 19 become decreasingly flexible as the distance along the supporting curve increases from the support arm enabling the support structure to flex in response to the force exerted by the passing carriage without changing the shape of the horizontal support arm 17. This variable flexibility enables the support tower to accomodate variable forces successfully.

Figure 3:
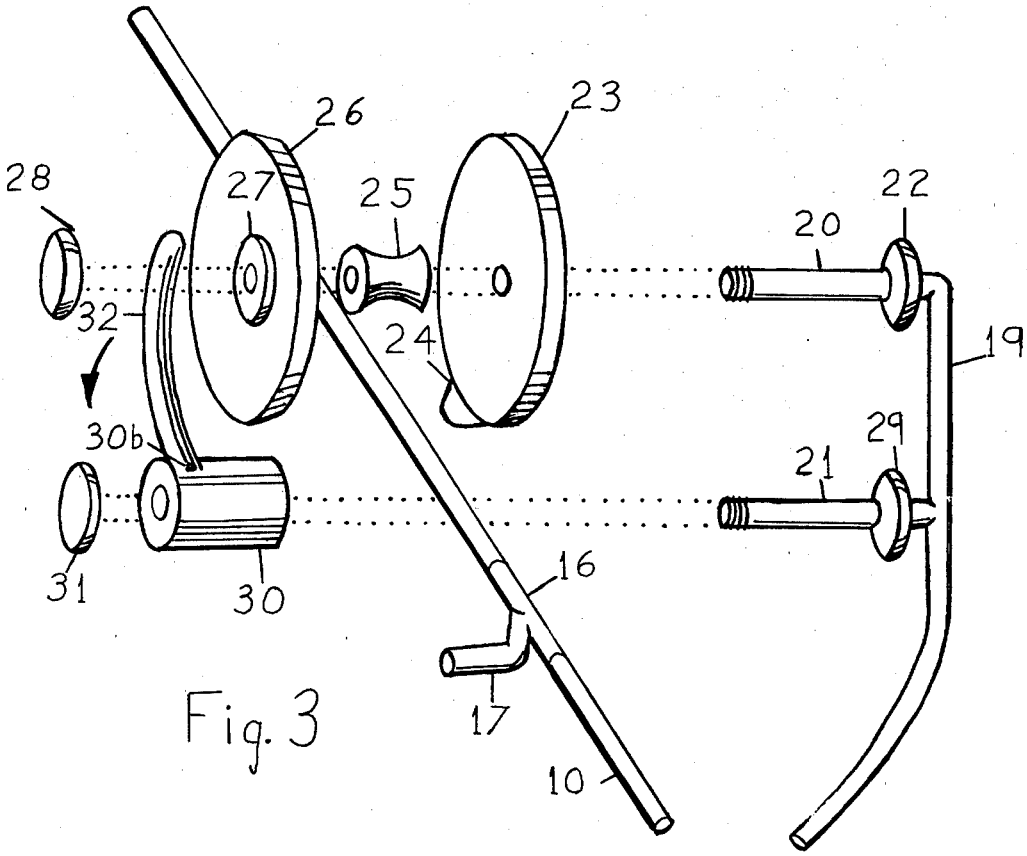
FIG. 3 is an exploded view of the trolley which rides upon the cable track.

FIG. 3 is an exploded view of the carriage trolley structure 18 comprising the frame 19 and the upper axle 20 and the lower axle 21. The upper axle supports the upper collar 22 which borders the large plate 23 and the cable brace 24 which borders the concave cable support wheel 25 which in turn borders the beveled wheel 26 and attached thereto is the lock lever collar 27, the entire assembly being held to the upper axle 20 by the end cap, and lock lever release **30*b***.

The lower axle 21 supports the lower axle collar 29 which is adjacent to the lock lever 30 and is secured to the lower axle by the lower end cap 31.

The cable 10 supports the concave cable support wheel 25 and rides between the large plate 23 and the beveled wheel 26, and rides above the body of the lock lever 30. When the lock lever arm 32 is in the raised position (as illustrated), the cable is held in position by gravity. In the event that bouncing relatively lowers the position of the cable onto the body of the lock lever 30, the bevel of the beveled wheel 26 will direct the cable back to the intended position. Since the lock lever rotates backward to accomodate the passing of the cable support arm 17, there appears the chance that the cable could position itself against the lock lever and force it backward, thereby freeing the cable from the carriage trolley structure 18. This possibility is only remotely likely to occur when the cable is taut because the force of the cable would be exerted parallel to the axis, the direction that said lock lever does not rotate. Said lock lever is spring forced, reciprocating, to return to its original position against said lock lever collar after allowing the passage of said cable support arm between said beveled wheel, and said lock lever body, while said cable is forced to its highest position against said concave support wheel, thereby effectively eliminating any possibility of said carriage leaving said cable when said lock lever is operationally discharged. Any chance that the carriage can leave said cable is entirely dependent on the cable being slack enough to bend and exert a force against the face of said lock lever, but the protrusion of the large plate 24 past the level of the beveled wheel prevents the inflexible cable from twisting sideways and exerting a force on any part of the face of said lock lever, except the side, which will cause no rotation of said lock lever.

In operation, the carriage is transported, however necessary, to the top of the hill upon which the cable and supporting structures are installed. The carriage is placed onto the cable either by inserting an end of the cable onto the concave cable support wheel, or by manually lowering the lock lever to allow the cable to slip into position through the opening between said beveled wheel and said lock lever body. The rider then mounts the carriage seat, frees the carriage of all restraints and said carriage is carried downhill along the path of the cable. When the carriage traverses the cable's horizontal support arm, said lock lever is disengaged backward to allow passage of said support arm, immediately returning to its original position after passage of said support arm. The cable and supporting structures are placed along the hillside in any pattern desired, leading to the bottom of the course. As the carriage swings around a curve, its centrifugal force is absorbed by the spring action of said supporting structure. An appropriate breaking system is installed at the end of the downhill course.

I claim the following:

1. A carriage trolley vehicle structure for use as a monorail trolley comprising a fixture suitable for use as a seat, supported by a frame and connected to the frame, a trolley system suitable to be mounted upon and ride along a track, said frame comprised of a means for attaching a fixture suitable suitable for use as a seat, connected to a vertical member and attached to said vertical member and perpendicular to its axis, two parallel axles, the upper axle from its closed end, containing a collar which supports a non-rotating plate, said plate extending from the upper axle to a point below the lower axle, adjacent to said plate, a wheel means capable of riding along a track, and a beveled wheel, beveled toward said wheel means, and attached to said beveled wheel, a smaller wheel, and said components being secured to the upper axle by a closure, the lower axle from its closed end containing a collar which supports a reciprocating lock lever comprised of a cylinder containing an aperature for mounting on said lower axle and essentially perpendicular to its axis, a lever, said lever resting against said smaller wheel, so that said lever may be dislodged by passing a track support arm, in which case it returns to its original position against said smaller wheel after the passing of said track support, or unless said lever is deliberately manually discharged.

* * * * *